United States Patent [19]

Loeber

[11] 4,355,723

[45] Oct. 26, 1982

[54] SHIPPING CONTAINER WITH COIL SPRING SUPPORTS

[76] Inventor: Fred M. Loeber, 1907 New Castle Ct., Arlington, Tex. 76013

[21] Appl. No.: 144,832

[22] Filed: Apr. 29, 1980

[51] Int. Cl.[3] ..... B65D 90/16

[52] U.S. Cl. ..... 206/599; 108/55.1; 206/521; 220/1.5; 220/441; 267/166

[58] Field of Search ..... 217/43 A; 220/1.5; 206/386, 522, 521, 591, 599; 229/6 R, 23 A; 108/51.1, 51.3, 55.1, 55.3, 55.5, 56.1, 56.3; 248/581, 599, 600; 267/4, 166, 9 R, 178, 60, 61 R, 180

[56] References Cited

U.S. PATENT DOCUMENTS

| | | | |
|---|---|---|---|
| 1,812,861 | 7/1931 | Chase | 108/51.1 |
| 3,426,986 | 2/1969 | Pool | 108/56.1 |
| 3,552,466 | 1/1971 | Fairchilds | 206/522 |
| 3,587,794 | 6/1971 | Mattel | 206/522 |
| 3,655,087 | 4/1972 | Luisada | 220/1.5 |
| 3,828,965 | 8/1974 | Yarbrough | 220/1.5 |
| 4,090,659 | 5/1978 | Galmiche et al. | 217/43 A |

FOREIGN PATENT DOCUMENTS

| | | | |
|---|---|---|---|
| 698005 | 1/1931 | France | 267/180 |
| 958500 | 5/1964 | United Kingdom | 206/522 |

*Primary Examiner*—Stephen Marcus

[57] ABSTRACT

A collapsible, specialized, shipping container for being transported upon a common carrier vehicle, the container being of a size so as to be easily handled, which being able to contain a large number of individual items, and generally comprising a box with a door on one side.

2 Claims, 10 Drawing Figures

SurePak
LOCAL TRANSPO CO.

SHIPPING CONTAINER WITH COIL SPRING SUPPORTS

This invention relates generally to large volume shipping containers for commercial goods.

It is well known, to those acquainted with the particular field, that the shipment of commercial goods between cities in different parts of the country involves considerable, costly time-consuming, transfer work. Goods do not travel in a steady, uninterrupted straight line by a carrier from a shipper directly to a consignee.

For example, in the garment industry, a small truck makes a pick-up in the congested garment district of New York City. The truck is that of a specialized carrier, and equipped with rods on which the garments are hung from hangers, as wearing apparel is no longer boxed in shipment. The apparel is counted when loaded. In New Jersey, it is unloaded at a freight depot, where it is then re-loaded on large rod-equipped, interstate vans for long distance haul, such as, for example, to Dallas, Tex. At each transfer of the goods, they are recounted. On the van, they may travel along with goods of other shippers, and there is always a possibility of mixing goods. In Dallas, the same transferring occurs, at the depot, to local specialized trucks, for local delivery, with the same counting and checking of individual pieces. Similar conditions exist in shipments of other industries. This situation is, accordingly, in need of improvement.

Therefore, it is a principal object of the present invention to provide a shipping container, for being filled with goods and then sealed at a shipper's premises, and which then is transported as a single unit, by a carrier, to the consignee, so as to save on record-keeping of the individual content therewithin.

Another object is to provide a shipping container, which is collapsible, and which may be made specialized, so as to eliminate the necessity of making trucks and vans specialized instead. This results in the elimination of the unprofitable return of empty, specialized vehicles back to an original starting point, for subsequent trips. In the above-indicated example, the traffic of wearing apparel is generally in one direction, from New York to Dallas, so that the specialized vehicles return to New York empty, at a loss in profits to the carrier. The collapsible, specialized shipping container would permit use of a common carrier, instead of a specialized carrier. One carrier could dispatch a fleet of several vehicles carrying garments from New York to Dallas, and instead of returning empty, all the containers would be collapsed, so as to be all shipped back, in a single vehicle, while the other vehicles are used to carry profitable loads eastward. This single direction traffic exists in numerous other fields, such as western fruit produce for eastern markets, and the like.

Other objects of the present invention are to provide a shipping container, which is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4, 5, 6, 7, 8, 9, 10:
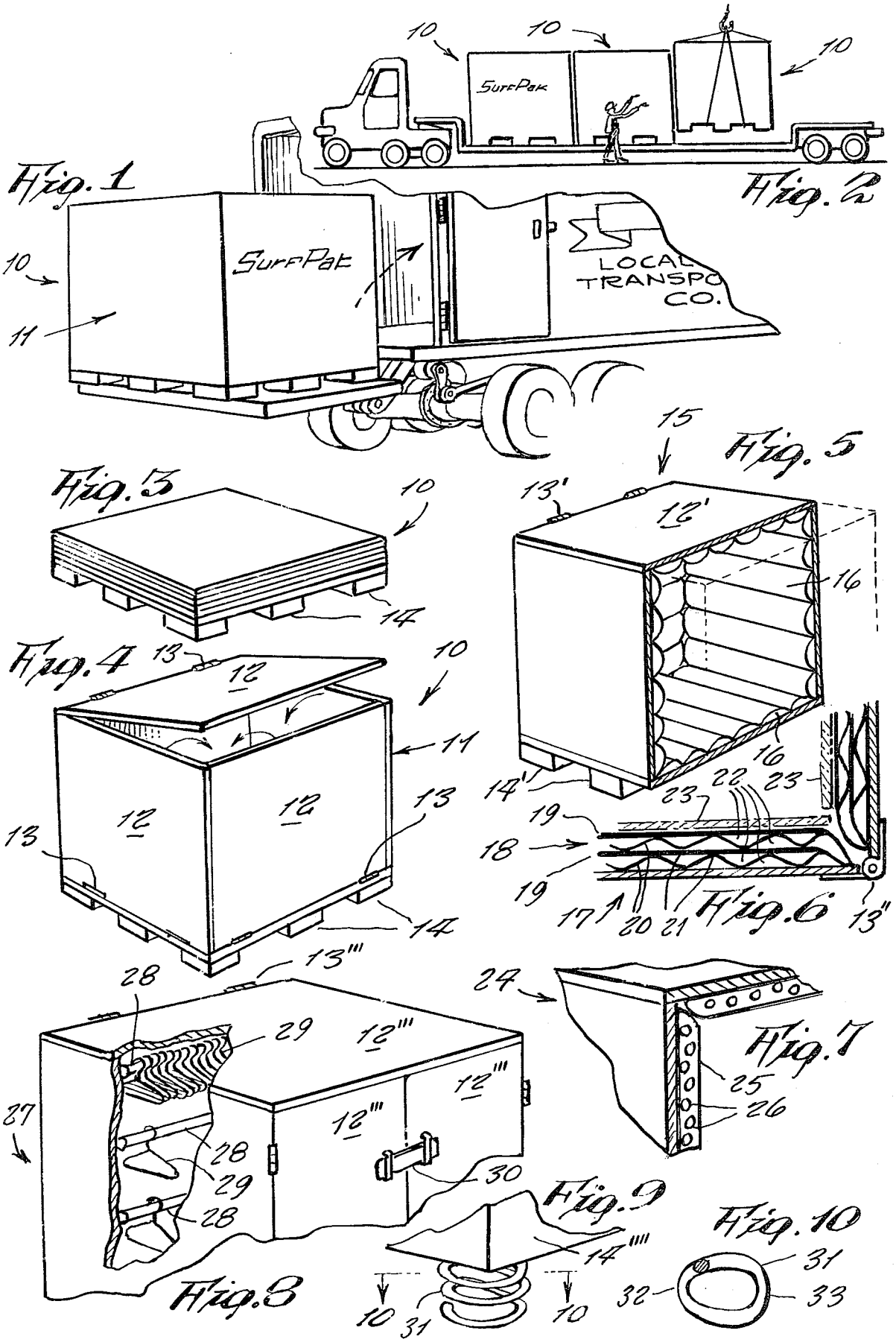
FIG. 1 is a perspective view of the Surfpac invention, being loaded on a local shipper's truck.
FIG. 2 illustrates several of the containers being loaded on a long distance shipper's truck trailer or van.
FIG. 3 is a perspective view of the container in a collapsed condition.
FIG. 4 is a similar view thereof, shown erected.
FIG. 5 is a cross-sectional perspective view of another design of container, which is padded, on its inner side, by air-inflatable rubber padding.
FIG. 6 is a cross-sectional view of a modified design of the padding, which, additionally, has thermal insulation characterisics, so as to be used with perishable goods.
FIG. 7 illustrates a container with dry-ice refrigerant.
FIG. 8 shows a container for transport of garments.

FIG. 9 shows another design of container foot, that comprises a compression spring, so that it has shock absorber characteristics, for transport of delicate mechanisms, and FIG. 10 is a view in direction 10—10 of FIG. 9, showing a spring that tends to sway in one direction, instead of at right angles thereto, so as to decrease the tendency of adjacent containers to bump each other, while still being free to sway during transportation.

Referring now to the drawing in greater detail, and more particularly to FIGS. 1 through 4 thereof at this time, the reference numeral 10 represents a shipping container, according to the present invention, and which comprises a collapsible rectangular box 11, that includes one or more sides thereof made into a door 12 pivotable bout hinges 13, so that the interior is accessible for placement of any of various goods therewithin. The box may be made in a size suitable for easy handling, while holding a desired large volume. A box measuring ninety inches by ninety inches by eighty-four inches is ideal for van and truck transportation. The box may be of any suitable material, so as to be strong and waterproof. It may be a fiberglass honey-combed material for certain uses. A bottom wall is made integral with pads 14.

In a collapsed position, the box can be dismantled, or folded up into the condition shown in FIG. 3, so as to take a minimum storage space.

Another design of shipping container 15, shown in FIG. 5, includes an air-inflated padding 16 on its inner side, so as to protect goods, such as electronic instruments and the like, from road shock, during transportation.

A modified design of this is shown in FIG. 6, wherein container 17 includes a padding 18, having thermal insulation characteristics, by including parallel spaced-apart flat rubber walls 19, and a corrugated rubber wall 20 on one side of each, with one wall 20 being therebetween. It is to be noted, that the contact points 21, of one wall 20 with the wall 19, are disaligned with the contact points 21 of the other wall 20, so that there is less thermal insulation loss through conduction, and four layers of air spaces 22 are provided, between an exterior and interior of the container. Flat panels 23, of wood or other stiff material, protect the padding 18 from injury by the goods placed in the box.

In FIG. 7, another specialized container 24 includes a metal, thermal insulation hollow vessel 25, on its inner side, that is filled with dry ice 26 or the equivalent, so as to be used for quickly perishable foods, such as fish or the like.

In FIG. 8, a specialized container 27, for transporting wearing apparel, includes bars 28, from which garment hangers 29 are supported. As shown, a latch 30 is provided on all the above described containers, and on which a seal can be attached, so as to insure the box having been unopened during shipment.

FIGS. 9 and 10 show a compression coil spring 31, affixed on an underside of a pad 14''', so as to serve as a shock absorber to the box during transportation, the spring being designed with each elliptical turn thereof being gradually thinned at opposite ends 32 and 33 of different arc length, the thinned ends of all turns being axially aligned, so that container sway is controlled into one directional plane only, in order not to bump containers together.

It is to be noted, that the shipping container of the present invention may be designed for all carriers, including truck, railroad, airplane and sea vessel. It may be variously exploited, such as by a leasing company to all carriers, and trademarked, such as by a name as "Surfpac" or the like, so as to become well known to all in the transportation field.

While various changes may be made in the detail construction, it is understood that such changes will be within the spirit and scope of the present invention, as is defined by the appended claims.

What I now claim is:

1. A shipping container, for commercial carrier use, comprising, in combination, a box, an access door on said box for loading and unloading of goods therein, and said box being collapsible; said box including thermal insulation means, padding, and shock absorbing means consisting of compression coil springs affixed to an underside of pads mounted beneath said box, each said spring including a plurality of elliptical turns, each of which is thinned at diametrically opposite longitudinal ends, so as to be more resilient at said longitudinal ends.

2. The combination as set forth in claim 1, wherein said container additionally includes latching means, adaptable for receiving a seal, for insurance against unofficial opening of said container.

* * * * *